United States Patent [19]

Economy et al.

[11] 3,942,947

[45] Mar. 9, 1976

[54] DYEING NOVOLOID FIBERS WITH DISPERSE DYES

[75] Inventors: James Economy, Eggertsville; George Y. Lei, Williamsville, both of N.Y.

[73] Assignee: The Carborundum Company, Niagara Falls, N.Y.

[22] Filed: Sept. 19, 1974

[21] Appl. No.: 507,312

[52] U.S. Cl. ..... 8/93; 8/115.5; 8/168 R; 8/DIG. 3

[51] Int. Cl.[2] ..... C09B 67/00

[58] Field of Search ..... 8/115.5, 168, DIG. 3, 93; 264/176 F

[56] References Cited

UNITED STATES PATENTS

| | | | |
|---|---|---|---|
| 3,716,521 | 2/1973 | Economy et al. | 264/176 F |
| 3,808,289 | 4/1974 | Okuhashi et al. | 264/176 F |

OTHER PUBLICATIONS

Du Pont Technical Information — Nylon — Bulletin N-249; June 1971.

*Primary Examiner*—V. P. Hoke
*Attorney, Agent, or Firm*—David E. Dougherty; Raymond W. Green; Herbert W. Mylius

[57] ABSTRACT

Compositions are disclosed for dyeing cross-linked novolac fibers, and blends thereof, using disperse dyes.

4 Claims, No Drawings

DYEING NOVOLOID FIBERS WITH DISPERSE DYES

BACKGROUND OF THE INVENTION

The present invention relates to dyeing of cross-linked phenolic resin fibers and blends thereof, using disperse dyes.

Novoloids, infusible cured phenolic resins containing at least 85 percent cross-linked novolac, may be produced by fiberization of a novolac melt and subsequent cross-linking or curing to an infusible stage. Curing may be effected in the presence of a source of methylene groups, such as paraformaldehyde, formaldehyde, or hexamethylenetetramine, and preferably also in the presence of an acidic or basic catalyst. Such novoloid fibers are disclosed in the following U.S. patents, which are incorporated herein by reference: U.S. Pat. No. 3,650,102, issued Mar. 21, 1972, to Economy et al.: U.S. Pat. No. 3,716,521, issued Feb. 13, 1973, to Economy et al.; and U.S. Pat. No. 3,723,588, issued Mar. 27, 1973, to Economy et al. Novoloid fibers may be formed into felts, mats, cloths, rovings, or other useful embodiments in accordance with conventional fiber handling techniques. A fabric of such fibers is disclosed by U.S. Pat. No. 3,628,995, issued Dec. 21, 1971, to Economy et al.

Novoloid fibers have a number of highly desirable attributes which render them of value in numerous applications. Their most outstanding virtue is excellent flame resistance. When subjected to flame, the infusible fibers do not melt, but rather char to produce carbon fibers, which continue to retain the shape and approximate dimensions of the original fibers, and which continue to afford extremely effective protection from flames. Accordingly, the fibers are of great utility in the fabrication of flame-protective clothing, as well as drapes, carpeting, upholstery, and the like which are especially suited for use in areas where fire constitutes a particular hazard. Such fibers also provide very effective thermal and accoustical insulation, and again are particularly useful for these applications where fire is a hazard. The fibers have suitable mechanical properties, such as tenacity and break elongation, to permit their being processed into yarns, woven and knitted fabrics and the like, as well as various non-woven forms such as felt, batting, and paper.

Notwithstanding such desirable attributes, infusible cured phenolic resin fibers have several disadvantages. Just after curing they are generally quite intensely colored, the hue ranging from very pale yellow to gold. Moreover, upon standing, the coloration may increase considerably in intensity, becoming deep brown or reddish brown. Thus, the fibers are known to possess rather poor color fastness.

Such novoloid fibers are particularly resistant to normal commercial dyeing processes. Accordingly, it has been difficult to obtain fibers and/or fabrics of the desired range of colors and color fastness. This detriment has a marked effect upon their acceptance by the textile industry and by the consumer with respect to applications for such fibers and fabrics in which color is an important factor.

In an attempt to overcome the deep coloration of such fibers, esterification or etherification of the phenolic hydroxyl groups may be utilized. In accordance with U.S. Pat. No. 3,716,521, of Economy et al., infusible cured phenolic resin fibers may be reacted with any of a wide variety of suitable esterification or etherification reagents, at a suitable temperature, for sufficient time to block at least about 50 percent, and preferably about 90 percent, of the phenolic hydroxyl groups of the cured resin. The blocking of phenolic hydroxyl groups may be accomplished after the resin has been cured to the point of infusibility, notwithstanding the cross-linked nature of the resin. Such fibers, while generally white in color and quite colorfast, have also, in the past, been difficult to dye to desired shades using commercially acceptable dyeing processes.

Disperse dyes, which are sparingly water-soluble, dye certain fibers such as cellulose acetate, nylon, or polyesters by diffusion into the fiber and are not attached to specific dye sites. This mechanism is sometimes referred to as "solid-solution dyeing".

SUMMARY OF THE INVENTION

In accordance with the present invention, infusible cured phenolic resin fibers, and blends thereof, may be subjected to commercial scale dyeing processes utilizing disperse dyes. The invention preferably comprises a dyeing formulation comprising from about 5 to about 7.5 percent dye (based on fiber weight), at least about six percent benzyl alcohol, and one percent acetic acid. The use of the proper proportions of acetic acid and benzyl alcohol are considered critical for promoting dye exhaustion.

DESCRIPTION OF PREFERRED EMBODIMENTS

Exemplary of infusible phenolic resins considered suitable for dyeing in accordance with the present invention are those set forth by U.S. Pat. No. 3,650,102, of Economy et al. Cross-linked novolac fibers of this nature have been granted the designation "Novoloid" by the U.S. Federal Trade Commission, and are available from The Carborundum Company of Niagara Falls, New York, under the Trademark KYNOL$^{tm}$. Such fibers are produced by the formation of a melt of a fusible novolac which is capable of cross-linking in the presence of a suitable aldehyde, fiberization of said melt to form thermoplastic fusible fibers, and cross-linking thereof by heating in the presence of methylene groups to render them infusible.

Other suitable fibers include the aforementioned esterified or etherified resin fibers as prepared in accordance with U.S. Pat. No. 3,716,521, of Economy et al.

In addition, blends of these two infusible phenolic resin fibers may be dyed in accordance with the present invention, as well as blends of an infusible phenolic resin fiber with a minor proportion of aromatic polyamide fibers. Suitable aromatic polyamides include various nylon fibers, a preferred example being Nomex, an aromatic polyamide available from E. I. duPont de Nemours & Company. Blends of novoloid with up to 20 weight percent polyamide may be successfully subjected to dyeing in accordance with the present invention. While the polyamide fibers themselves are not strongly dyed by the dye baths of the present invention, the intense coloration of the novoloid fibers masks the weak coloration of a minor proportion of polyamide fiber.

The dyeing process of the present invention utilizes a dye carrier and acetic acid. As the dye carrier, benzyl alcohol is utilized. When dyeing 100 percent novoloid, or blends of novoloid/polyamide, at least 3 percent carrier by volume is desirable, with a range of from about 3 percent to about 10 percent carrier being suitable. The use of at least about one percent to two percent by volume, based on the dyeing bath, of acetic acid is employed in the dye bath to control pH and to promote dye exhaustion. This is conveniently added as a 56 percent solution in formulating the dyeing bath.

In addition, the use of a small amount, i.e., less than 1.0 weight percent, of a surface active agent is advantageous as a wetting agent. Various organic derivatives such as sodium salts of high molecular weight alkyl sulfates or sulfonates may be used, with about 0.08 percent by weight of Merpol SE surface active agent, available from E. I. duPont de Nemours & Company, being a preferred example.

From about 2 to about 10 percent or higher, and preferably from 5 to 9 percent of the selected dye, based on weight of the fiber, is utilized. Various disperse dyes may be used in the composition of this invention. Exemplary suitable dyes include Estracyl yellow ZRN, golden orange G, scarlet 2GH, blue G SH; Latyl cerise B, available from E. I. duPont de Nemours & Company, and others. The selected dye is dispersed in distilled, soft, or deionized water to avoid formation of precipitates with magnesium, calcium, or other elements normally found in water.

Light stabilizers may also be utilized to enhance lightfastness. Exemplary of such compositions are substituted hydroxyphenyl benzotriazole ultraviolet absorbers, such as Tinuvin P, available from Ciba-Geigy, or Rylex H, a hydroquinone ultraviolet absorber available from E. I. duPont de Nemours & Company. These may optionally be used in concentrations of from about 0.1 to about 10 percent by weight of the fiber.

While for purposes of experimental laboratory dyeing, the fiber or fabric may be added to the completely mixed dye bath, it will be understood that in commerical dyeing equipment, different procedural steps may be followed. Thus, the dye bath ingredients may be added directly to the fibers in the dyeing equipment, for example.

The invention is further illustrated by the following Examples, although it is to be understood that the Examples are intended for purposes of illustration only and are not intended to limit the scope of the invention.

EXAMPLE 1

A fiber sample comprising KYNOL$^{tm}$ fibers, a novoloid fiber available from The Carborundum Company is subjected to scouring to remove all traces of sizing, lubricants, or soil accumulation. Scouring is carried out with a surface active agent such as a soap or synthetic detergent. The undyed fiber is gold in color.

Merpol HCS surface active agent and tetrasodium pyrophosphate are added to distilled water at 27°C to form a 1 percent solution of each, by weight of the bath. The fiber is added to the scouring bath, and the temperature raised to 88°C at a rate of 1.5°C per minute, and run at that temperature for 20 minutes. The bath is then cooled to 38°C, and the fiber is removed and thoroughly rinsed with warm water.

The dye bath is made up using 8.5 percent Estracyl scarlet 2GH dye, based on fiber weight, with the bath ratio set at 30 cc./gram of fiber. The dye is added, with 0.8 grams/liter Merpol SE surface active agent, at 50°C while stirring. then 60 grams/liter of benzyl alcohol is added, and the bath is run for 3 minutes to achieve a uniform dispersion. Ten ml/liter acetic acid (56 percent) is added, the fibers are placed in the bath, and the bath temperature is raised to 127°C at a rate of 1.6°C/minute. The bath is run for 1.5 hours at 127°C, cooled to 50°C, and dropped. The fiber is then rinsed with warm water (50° to 60°C).

The dyed fibers are after-scoured to remove the carrier and other organic ingredients from the finished product by washing in a bath comprising one percent Merpol HCS and 0.5 percent acetic acid. The bath is set at 50°C, raised to 82°C at a rate of 1.5°C per minute, and run for 15 minutes. The fibers are then rinsed in 50° to 60° water, and dried. The resulting fibers are bright red, uniformly colored, and exhibit only slight fade after 20 hours under a xenon arc light.

EXAMPLE 2

A sample of an esterified novoloid fiber prepared in accordance with U.S. Pat. No. 3,716,521 is subjected to dyeing in accordance with the procedure and composition set forth in Example 1. The resultant dyed fiber is equally intensely colored, and exhibits similar brightness and lightfastness.

EXAMPLE 3

Fabric samples comprising KYNOL$^{tm}$ fiber and Nomex fiber in a ratio of 80/20 are subjected to dyeing in accordance with the process of Example 1. Uniform colors are obtained using from 6 to 8.5 percent of the dyes Estracyl yellow ZRN (200%), Estracyl scarlet 2 GH, and Latyl cerise B.

EXAMPLE 4

Samples of KYNOL$^{tm}$ novoloid fiber, and 80/20 blends of KYNOL$^{tm}$ novoloid fiber and Nomex polyamide fiber are dyed in accordance with Example 1, and subjected to xenon arc light to test lightfastness. The results are set forth in Table I.

TABLE I

Hues and Lightfastness of KYNOL$^{tm}$ and KYNOL$^{tm}$/Nomex Fibers Dyed with Disperse Dyes

| Desired Hue | Dye | % Dye | Lightfastness (Xenon-arc) 20 Hours | 30 Hours | Fade |
|---|---|---|---|---|---|
| YELLOW | Estracyl yellow ZRN 200% | 8.5 | 4 | 3–4 | DR |
| ORANGE | Estracyl golden orange G | 8.5 | 5 | 4–5 | W |
| RED | Estracyl scarlet 2 GH | 8.5 | 4–5 | 4 | D |
| BLUE | Estracyl blue G SH | 8.5 | 4 | 3 | DW |
| RED | Latyl cerise B | 6.0 | 4 | 3–4 | W |

Key to Shade Change

| | |
|---|---|
| 5 - None | B - Browner |
| 4 - Slight | D - Duller |
| 3 - Noticeable | R - Redder |
| 2 - Considerably | W - Weaker |

TABLE I-continued

| Hues and Lightfastness of KYNOL™ and KYNOL™/Nomex Fibers Dyed with Disperse Dyes | | | | | |
|---|---|---|---|---|---|
| Desired Hue | Dye | % Dye | 20 Hours | Lightfastness (Xenon-arc) 30 Hours | Fade |
| | 1 - Much Changed | | Y - Yellower | | |

Percentages as set forth herein are based upon the following: fiber blends upon total weight of fibers; dye and stabilizer concentrations upon weight of fiber to be dyed; benzyl alcohol and acetic acid upon volume of dye bath; and surface active agent upon weight of dye bath.

While the invention has been described herein with reference to certain preferred embodiments, it is to be understood that various changes and modifications may be made by those skilled in the art without departing from the concept of the invention, the scope of which is to be determined by reference to the following claims.

What is claimed is:

1. A composition for dyeing novoloid fibers, said composition comprising, per liter,

1. from about ⅓ to about 3⅓ grams disperse dye;
2. from about 30 to about 100 ml benzyl alcohol;
3. from about 10 to about 20 ml acetic acid; and
4. water.

2. A composition as set forth in claim 1 wherein said dye is present in a concentration of from five to about nine percent.

3. A composition as set forth in claim 1 wherein said composition further comprises less than 1.0 weight percent surface active agent.

4. A dye bath comprising, per liter,

1. from 1⅔ to 3 grams disperse dye;
2. about 60 ml of benzyl alcohol;
3. from about 10 to about 20 ml acetic acid; and
4. water.

* * * * *